US009341125B2

(12) United States Patent
Goho et al.

(10) Patent No.: US 9,341,125 B2
(45) Date of Patent: May 17, 2016

(54) ENGINE CONTROL APPARATUS AND ENGINE CONTROL METHOD

(71) Applicant: MITSUBISHI ELECTRIC CORPORATION, Chiyoda-ku, Tokyo (JP)

(72) Inventors: Manabu Goho, Kobe (JP); Ryo Sakaguchi, Chiyoda-ku (JP); Yasuhiko Ishida, Kobe (JP)

(73) Assignee: Mitsubishi Electric Corporation, Tokyo (JP)

( * ) Notice: Subject to any disclaimer, the term of this patent is extended or adjusted under 35 U.S.C. 154(b) by 145 days.

(21) Appl. No.: 14/333,663

(22) Filed: Jul. 17, 2014

(65) Prior Publication Data

US 2015/0059693 A1 Mar. 5, 2015

(30) Foreign Application Priority Data

Aug. 28, 2013 (JP) ..... 2013-176385

(51) Int. Cl.
*F02D 31/00* (2006.01)
*F02D 11/10* (2006.01)

(52) U.S. Cl.
CPC ..... *F02D 31/002* (2013.01); *F02D 11/105* (2013.01); *F02D 31/003* (2013.01); *F02D 2200/0404* (2013.01); *F02D 2200/101* (2013.01); *F02D 2200/602* (2013.01)

(58) Field of Classification Search
CPC ..... F02D 9/105; F02D 31/00; F02D 31/001; F02D 31/002; F02D 41/10; F02D 41/045; F02D 2200/0404; F02D 2200/501; F02D 2200/602
USPC ..... 123/319, 334, 339.2, 361, 376, 399, 123/403; 701/102, 110, 114
See application file for complete search history.

(56) References Cited

U.S. PATENT DOCUMENTS

| | | | | |
|---|---|---|---|---|
| 6,725,833 | B1 * | 4/2004 | Irihune | F02D 9/10 123/361 |
| 8,406,981 | B2 * | 3/2013 | Tetsuka | F02D 9/02 123/403 |
| 2003/0084873 | A1 * | 5/2003 | Ishida | F02D 11/105 123/399 |
| 2006/0213483 | A1 * | 9/2006 | Miyachi | F02D 41/107 123/399 |

FOREIGN PATENT DOCUMENTS

| | | | |
|---|---|---|---|
| JP | 2-238136 | A | 9/1990 |
| JP | 2000-110635 | A | 4/2000 |
| JP | 2008-231939 | A | 10/2008 |

* cited by examiner

*Primary Examiner* — John Kwon
*Assistant Examiner* — Johnny H Hoang
(74) *Attorney, Agent, or Firm* — Sughrue Mion, PLLC; Richard C. Turner

(57) ABSTRACT

When an accelerator operation amount is 0, a throttle actuator is controlled by means of isochronous control by using a second throttle operation amount (θtps2) for the isochronous control, and, on the other hand, when the accelerator operation amount is not 0, the throttle actuator is controlled by means of droop control by using a first throttle operation amount (θtps1) for the droop control. When an engine rotation speed is equal to or lower than a LOW rotation speed, larger one of the first and second throttle operation amounts (θtps1 and θtps2) is used, and when the engine rotation speed is equal to or higher than a HIGH rotation speed, smaller one of the first and second throttle operation amounts (θtps1 and θtps2) is used, to thereby control the throttle actuator by means of the isochronous control.

6 Claims, 10 Drawing Sheets

ENGINE CONTROL APPARATUS AND ENGINE CONTROL METHOD

TECHNICAL FIELD

The present invention relates to an engine control apparatus and an engine control method, and more particularly, to an engine control apparatus and an engine control method for a general-purpose engine.

An electronic governor mechanism is conventionally known as a control apparatus for a general-purpose engine. For example, an electronic governor mechanism for a compression-ignition engine (diesel engine) is a control apparatus which controls a fuel injection amount of the engine so as to stabilize an engine rotation speed at a target rotation speed. As methods for controlling the fuel injection amount, isochronous control and droop control are known.

In the isochronous control, when a load of the engine fluctuates to generate a deviation between the target rotation speed and an actual rotation speed, the deviation is controlled so as to be eliminated.

The isochronous control in a compression-ignition engine corrects the fuel injection amount to control the rotation speed so as to maintain the target rotation speed.

Moreover, in the isochronous control in a spark-ignition engine, the spark-ignition engine includes an actuator for opening/closing a throttle, and the isochronous control opens/closes the throttle to change an air amount taken into the engine, thereby providing such control that an engine rotation speed is consistent with a target rotation speed (for example, refer to Japanese Patent Application Laid-open No. Hei 2-238136).

On the other hand, when a load is imposed on an engine, the droop control decreases the engine rotation speed in response to a magnitude of the load.

The droop control in a compression-ignition engine provides such control as to increase a predetermined amount of a fuel in response to a deviation between a target rotation speed and an actual rotation speed, and to decrease the engine rotation speed when an external load exceeds a torque generated by the engine (for example, refer to Japanese Patent Application Laid-open No. 2008-231939).

Moreover, as a related-art control method, virtual droop control, which combines the isochronous control and the droop control with each other, is proposed (for example, refer to Japanese Patent Application Laid-open No. 2000-110635).

In the virtual droop control described in Japanese Patent Application Laid-open No. 2000-110635, control characteristics of a mechanical governor are realized by an electronic governor. In vessel engines, farm-vehicle engines, and construction-work vehicle engines, the engine rotation speed is reduced in accordance with an increase in engine load so that the degree of application of the load can be obtained based on the reduction in engine rotation speed. In the virtual droop control, engine-operation performance suited for a feeling of a driver is to be realized in the manner described above. Moreover, although a sense of discomfort is provided to the driver when sudden acceleration/deceleration is performed at the time of acceleration/deceleration in the case of the isochronous control, such a sense of discomfort can be reduced in the case of the droop control.

The related-art isochronous control has such a problem that sudden acceleration/deceleration occurs during acceleration/deceleration, and a driver thus feels a sense of discomfort.

Moreover, the related-art droop control can reduce the sense of discomfort, but there has been such a problem that a response during the acceleration and the deceleration is slow, resulting in stress felt by the driver.

Therefore, the related-art virtual droop control realizes the droop control by means of the isochronous control, and carries out feedback control so as to decrease the target rotation speed when the load increases so that the rotation speed is consistent with the target rotation speed, thereby realizing the droop control. However, in this case, gain adaptation for the feedback control is necessary so as to realize the isochronous control over an entire rotation range, and there has been such a problem that a lot of steps and processes for the adaptation are necessary.

On the other hand, in an engine including a mechanical governor, when the engine load increases, the engine rotation speed decreases, and the engine possibly stalls. Moreover, during operating at the maximum set rotation speed (high idle rotation speed) of the engine, when a load disappears, the engine is damaged if the engine rotation speed further increases. Therefore, such control that the fuel or the ignition is cut to prevent the damage so as to protect the engine (so-called over revolution control) is thus usually activated. When the over revolution control is activated, the engine rotation speed changes suddenly, and a user feels a sense of discomfort (refer to an operation shown in FIG. 8).

Moreover, a sudden change in load can occur in a usual application in a general-purpose engine, which is different from engines used for other applications (such as a four-wheeled vehicle). If a load is applied suddenly and the engine stalls, or if a load disappears suddenly and the rotation speed reaches an over revolution rotation speed, resulting in fluctuation in rotation speed, the driver feels a sense of discomfort.

SUMMARY OF INVENTION

The present invention has been made in view of the above-mentioned problems, and therefore has an object to provide an engine control apparatus and an engine control method capable of automatically switching a droop control method and an isochronous control method depending on the change in engine load in response to an operation state, thereby preventing a driver from feeling a sense of discomfort.

According to one embodiment of the present invention, there is provided an engine control apparatus for controlling an intake air amount supplied to an engine by means of an electronic throttle, thereby controlling an engine rotation speed of the engine by means of any one of a droop control method and an isochronous control method, the engine control apparatus including: an engine parameter calculation part for detecting the engine rotation speed; an accelerator operation amount detection part for detecting an accelerator operation amount; a target rotation speed calculation part for acquiring a LOW rotation speed, which is a minimum set rotation speed of the engine with respect to an engine coolant temperature of the engine, and a HIGH rotation speed, which is a maximum set rotation speed thereof, and selecting, based on the engine rotation speed and the accelerator operation amount, any one of the LOW rotation speed and the HIGH rotation speed as a target rotation speed of the engine; a droop control target throttle opening degree calculation part for calculating a first throttle operation amount for operating the electronic throttle by means of the droop control method based on the accelerator operation amount; an isochronous control target throttle opening degree calculation part for acquiring a deviation between the engine rotation speed and the target rotation speed, and calculating a second throttle operation amount for operating the electronic throttle by means of the isochronous control method based on the deviation; a control method determination part for selecting, based on the accelerator operation amount and the engine rotation speed, any one of the droop control method and the isochronous control method as a control method; a target throttle opening degree calculation part for selecting, based on the accelerator operation amount and the control method, any one of the first throttle operation amount and the second throttle operation amount as a target throttle opening degree; and an electronic throttle control part for controlling the electronic throttle based on the target throttle opening degree, in which: when the accelerator operation amount is 0, the target throttle opening degree calculation part selects the second throttle operation amount, and the electronic throttle control part uses the second throttle operation amount, thereby controlling the electronic throttle by means of the isochronous control method; and when the accelerator operation amount is not 0, in a case where the engine rotation speed is one of equal to or lower than the LOW rotation speed and equal to or higher than the HIGH rotation speed and the control method determination part selects the isochronous control method as the control method, the target throttle opening degree calculation part selects any one of the first throttle operation amount and the second throttle operation amount, and the electronic throttle control part carries out, based on the selection, the control of the electronic throttle by means of the isochronous control method, and otherwise, the target throttle opening degree calculation part selects the first throttle operation amount, and the electronic throttle control part uses the first throttle operation amount, thereby controlling the electronic throttle by means of the droop control method.

According to one embodiment of the present invention, provided is the engine control apparatus for controlling the intake air amount supplied to the engine by means of the electronic throttle, thereby controlling the engine rotation speed of the engine by means of any one of the droop control method and the isochronous control method, the engine control apparatus including: the engine parameter calculation section for detecting the engine rotation speed; the accelerator operation amount detection section for detecting the accelerator operation amount; the target rotation speed calculation section for acquiring the LOW rotation speed, which is the minimum set rotation speed of the engine with respect to the engine coolant temperature of the engine, and the HIGH rotation speed, which is the maximum set rotation speed thereof, and selecting, based on the engine rotation speed and the accelerator operation amount, any one of the LOW rotation speed and the HIGH rotation speed as the target rotation speed of the engine; the droop control target throttle opening degree calculation section for calculating the first throttle operation amount for operating the electronic throttle by means of the droop control method based on the accelerator operation amount; the isochronous control target throttle opening degree calculation section for acquiring the deviation between the engine rotation speed and the target rotation speed, and calculating the second throttle operation amount for operating the electronic throttle by means of the isochronous control method based on the deviation; the control method determination section for selecting, based on the accelerator operation amount and the engine rotation speed, any one of the droop control method and the isochronous control method as the control method; the target throttle opening degree calculation section for selecting, based on the accelerator operation amount and the control method, any one of the first throttle operation amount and the second throttle operation amount as the target throttle opening degree; and the electronic throttle control section for controlling the electronic throttle based on the target throttle opening degree, in which: when the accelerator operation amount is 0, the target throttle opening degree calculation section selects the second throttle operation amount, and the electronic throttle control section uses the second throttle operation amount, thereby controlling the electronic throttle by means of the isochronous control method; and when the accelerator operation amount is not 0, in the case where the engine rotation speed is equal to or lower than the LOW rotation speed or equal to or higher than the HIGH rotation speed and the control method determination section selects the isochronous control method as the control method, the target throttle opening degree calculation section selects any one of the first throttle operation amount and the second throttle operation amount, and the electronic throttle control section carries out, based on the selection, the control of the electronic throttle by means of the isochronous control method, and otherwise, the target throttle opening degree calculation section selects the first throttle operation amount, and the electronic throttle control section uses the first throttle operation amount, thereby controlling the electronic throttle by means of the droop control method. Thus, it is possible to automatically switch the droop control method and the isochronous control method depending on the change in engine load in response to the operation state, thereby preventing the driver from feeling a sense of discomfort.

DESCRIPTION OF EMBODIMENTS

First Embodiment

Figure 1:
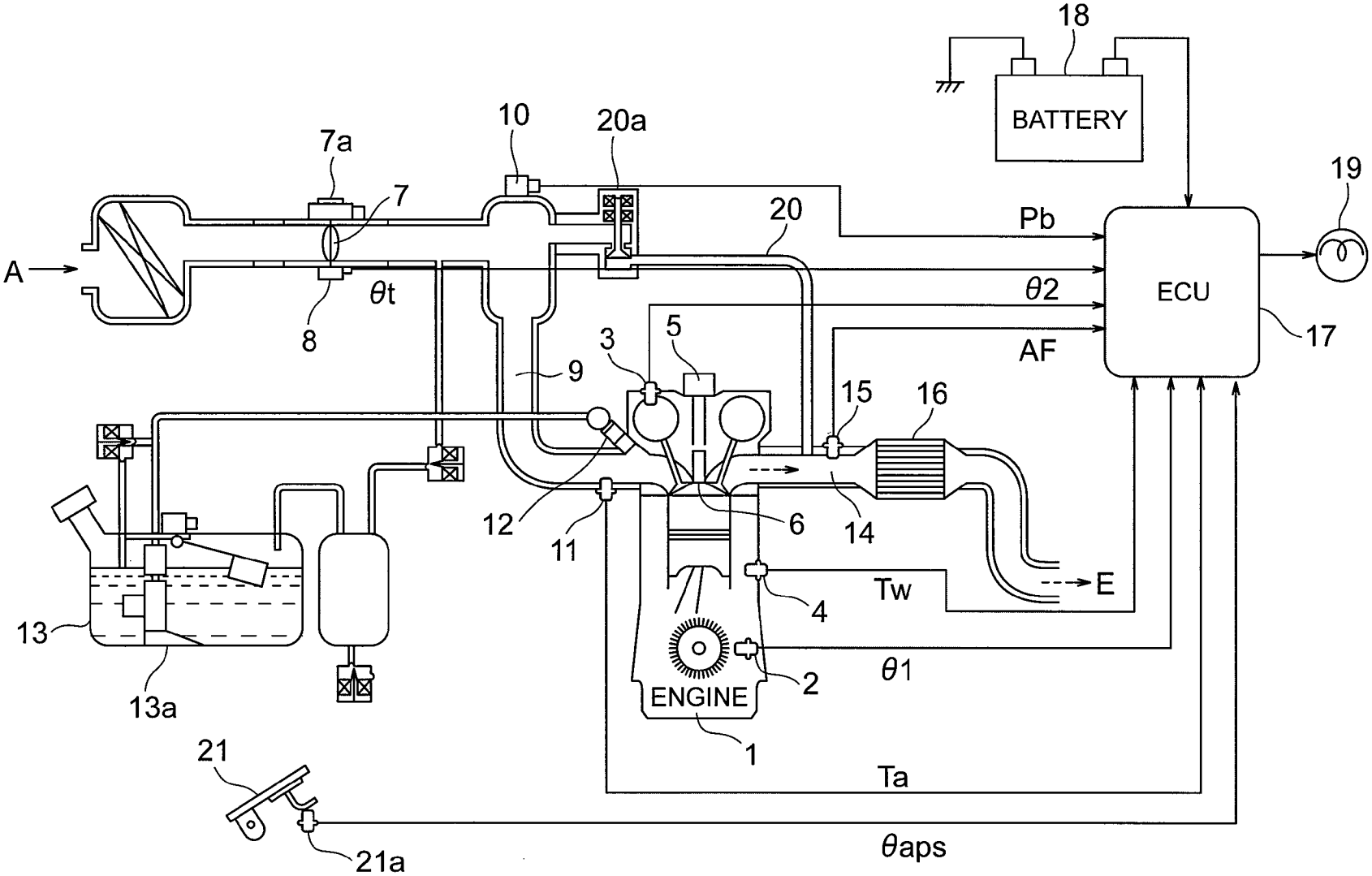
FIG. 1 is a configuration diagram illustrating an engine control apparatus and an overall system including the engine control apparatus according to a first embodiment of the present invention.

Now, an engine control apparatus according to a first embodiment of the present invention is described in detail referring to the accompanying drawings. In the drawings, the same or corresponding parts are denoted by the same reference symbols.

FIG. 1 is a configuration diagram illustrating the engine control apparatus and an overall system including the engine control apparatus according to the first embodiment of the present invention, and schematically illustrates the relationship between an internal combustion engine constituting an engine and the engine control apparatus. The engine control apparatus according to the first embodiment automatically switches a control method between a droop control method of decreasing an engine rotation speed as an engine load increases and an isochronous control method of controlling an actual rotation speed so that the actual rotation speed is consistent with a target rotation speed, in response to an operation state. A description is now given of the engine control apparatus according to the first embodiment.

As illustrated in FIG. 1, a general-purpose engine 1 subject to the control by the engine control apparatus according to the first embodiment (hereinafter simply referred to as "engine 1") is installed on a vehicle. The engine control apparatus according to this embodiment includes, as illustrated in FIG. 1, a crank angle sensor 2, a cam angle sensor 3, a water temperature sensor 4, an ignition coil 5, a spark plug 6, a throttle valve 7, a throttle actuator (electronic throttle) 7*a*, a throttle sensor 8, an intake passage 9, an intake-pressure sensor 10, an intake-air temperature sensor 11, an injector 12, a fuel tank 13, a fuel pump 13*a*, an exhaust passage 14, an $O_2$ sensor 15, a three-way catalyst 16, an electronic control unit (ECU) 17, a battery 18, an fault indicator 19, an EGR valve 20*a*, an EGR passage 20, an accelerator pedal 21, and an accelerator position sensor 21*a*.

The ignition coil 5, the spark plug 6, and the injector 12 are mounted to the engine 1. In addition, the intake passage 9 and the exhaust passage 14 are brought into communication with the engine 1 through the intermediation of an intake valve and an exhaust valve, respectively. In accordance with a load of the engine 1, the ECU 17 calculates a fuel amount to be supplied from the injector 12 to the engine 1 so as to achieve a target air/fuel ratio. Moreover, the ECU 17 calculates optimal ignition timing by the spark plug 6 based on an engine rotation speed and the engine load. Further, the ECU 17 calculates an optimal air amount to be supplied to the engine 1 and adjusts the air amount by the throttle actuator (electronic throttle) 7*a*.

The EGR passage 20 (bypass passage) brings the exhaust passage 14 and the intake passage 9 into communication with each other through the intermediation of the EGR valve 20*a*.

The throttle valve 7 for adjusting an intake-air amount sucked into the engine 1 and the throttle actuator 7*a* for driving the throttle valve 7 to be opened and closed are provided to the intake passage 9.

On the other hand, the three-way catalyst 16 for purifying an exhaust gas E exhausted from the engine 1 is provided in the exhaust passage 14.

The injector 12 injects the fuel (gasoline) supplied by the fuel pump 13*a* provided to the fuel tank 13 into the intake passage 9 corresponding to each cylinder of the engine 1. The ignition coil 5 supplies electric power energy to the spark plug 6. The spark plug 6 ignites an air-fuel mixture by using a discharge spark.

Next, various analog output sensors for detecting an operating state and a load state of the engine 1 are described. The crank angle sensor 2 detects a crank angle θ1. The cam angle sensor 3 detects a cam angle θ2. The water temperature sensor 4 detects an engine coolant temperature Tw. The intake-air temperature sensor 11 detects a temperature Ta of intake air A.

The throttle sensor 8 detects an angle θt of the throttle valve 7. The intake-pressure sensor 10 is provided at downstream of the throttle valve 7 and detects a pressure Pb in the intake passage 9. The $O_2$ sensor 15 is provided at upstream of the three-way catalyst 16 and outputs a detection value AF corresponding to an oxygen concentration (air/fuel ratio) in the exhaust passage 14.

The accelerator position sensor 21*a* (accelerator operation amount detection part) is mounted to the accelerator pedal 21. The accelerator position sensor 21*a* detects an accelerator operation amount θaps corresponding to the amount of operation performed by a driver. Although an analog sensor such as the accelerator position sensor 21*a* is illustrated as the accelerator operation amount detection part in FIG. 1, digital information from a switch or communication information from another unit as in the case of a controller area network (CAN) may also be used instead.

The various sensors described above are described as examples, and therefore all the various sensors are not required to be included as constituent features of the first embodiment of the present invention. Thus, only a part of the various sensors described above may be provided or other sensor (s) other than those described above may be additionally provided.

The detection information of the various sensors 2, 3, 4, 8, 10, 11, 15, and 21*a* described above is input to the ECU 17.

The ECU 17 computes a control amount for controlling the engine 1 based on the crank angle θ1 from the crank angle sensor 2, the cam angle θ2 from the cam angle sensor 3, and input information from the other various sensors so as to control the driving of various actuators such as the ignition coil 5, the throttle actuator 7*a*, and the injector 12.

The ECU 17 calculates a fuel injection amount based on the air amount supplied to the engine 1 in accordance with the load on the engine 1 so as to achieve a stoichiometric air/fuel ratio (target air/fuel ratio) and supplies the fuel from the injector 12 to the engine 1 based on the thus calculated injection amount. The ECU 17 also computes optimal ignition timing based on a rotation speed RE of the engine 1 and a load on the engine 1 to perform ignition at the spark plug 6. Moreover, the ECU 17 controls the air amount to be supplied to the engine 1 by using the throttle actuator (electronic throttle) 7*a*.

Moreover, the ECU 17 calculates a first throttle operation amount θtps1 for operating the electronic throttle by means of the droop control method, or calculates a second throttle operation amount θtps2 for operating the electronic throttle by means of the isochronous control method based on the accelerator operation amount θaps from the accelerator position sensor 21*a*, thereby providing the throttle actuator 7*a* (electronic throttle) with drive control.

The battery 18 is connected to the ECU 17. The battery 18 supplies electric power for an engine start or to various electric components such as a light.

When a fault occurs in any of the parts, the fault indicator 19 receives a signal from the ECU 17 to display the occurrence of the fault.

Figure 2:
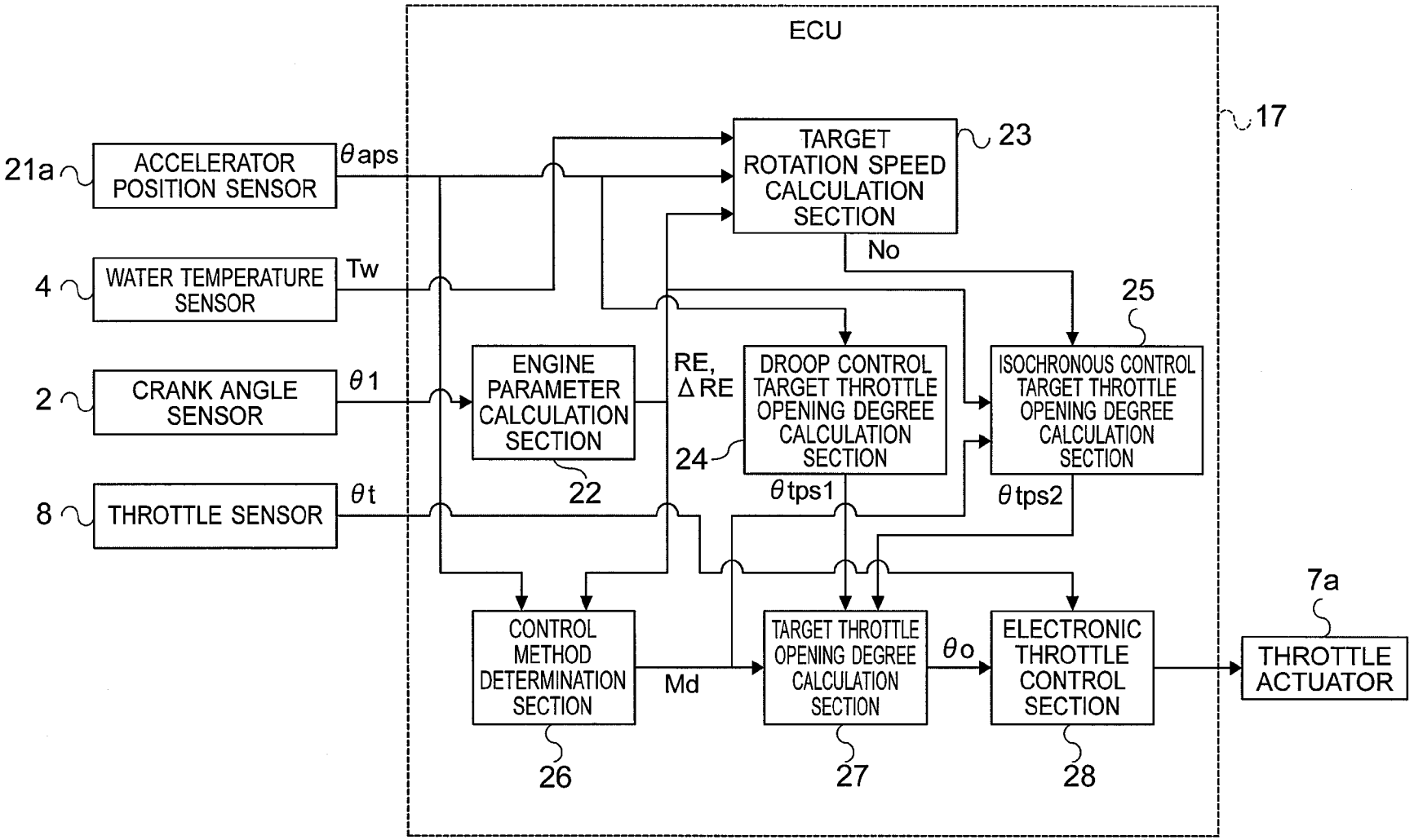
FIG. 2 is a block diagram illustrating a configuration of the engine control apparatus according to the first embodiment of the present invention.

FIG. 2 is a block diagram illustrating a functional configuration of the ECU 17 and mainly illustrates the functions relating to the calculation of the target rotation speed and the computation of a target throttle opening degree.

In FIG. 2, the ECU 17 includes an engine parameter calculating section 22, a target rotation speed calculation section 23, a droop control target throttle opening degree calculation section 24, an isochronous control target throttle opening degree calculation section 25, a control method determination section 26, a target throttle opening degree calculation section 27, an electronic throttle control section 28, and various actuator control sections (such as a fuel control section, an ignition control section) (not shown).

The engine parameter calculation section 22 acquires the engine rotation speed RE and a change amount ΔRE of the engine rotation speed RE during a predetermined period based on the crank angle θ1 from the crank angle sensor 2.

The target rotation speed calculation section 23 determines a LOW rotation speed and a HIGH rotation speed based on the engine coolant temperature Tw from the water temperature sensor 4 for preventing the engine from being damaged by a difference in engine friction or overheat. On this occasion, the LOW rotation speed and the HIGH rotation speed may be acquired by using input information from other various sensors and other control information. Moreover, the target rotation speed calculation section 23 acquires an accelerator operation amount threshold based on the engine rotation speed RE from the engine parameter calculation section 22, and compares the accelerator operation amount threshold and the accelerator operation amount θaps from the accelerator position sensor 21*a* with each other, thereby determining any one of the LOW rotation speed and the HIGH rotation speed as a target rotation speed No.

The droop control target throttle opening degree calculation section 24 calculates a first throttle operation amount θtps1 based on the accelerator operation amount θaps from the accelerator position sensor 21*a*.

The isochronous control target throttle opening degree calculation section 25 acquires a deviation Nerr between the target rotation speed No from the target rotation speed calculation section 23 and the engine rotation speed RE from the engine parameter calculation section 22, and calculates a second throttle operation amount θtps2 for providing such a control that the deviation Nerr approaches 0 in feedback control (PID control).

The control method determination section 26 determines whether to control the throttle actuator 7*a* by means of the droop control method or to control the throttle actuator 7*a* by means of the isochronous control method based on the accelerator operation amount θaps from the accelerator position sensor 21*a* and the engine rotation speed RE from the engine parameter calculation section 22, and outputs a signal (hereinafter referred to as control method Md) representing the determined control method.

The target throttle opening degree calculation section 27 sets any one of the first throttle operation amount θtps1 and the second throttle operation amount θtps2 as the target throttle opening degree θo based on the accelerator operation amount θaps and the control method Md.

The electronic throttle control section 28 controls the throttle actuator 7*a* based on the target throttle opening degree θo so that the angle θt of the throttle valve 7 from the throttle sensor 8 approaches the target throttle opening degree θo.

Figure 6:
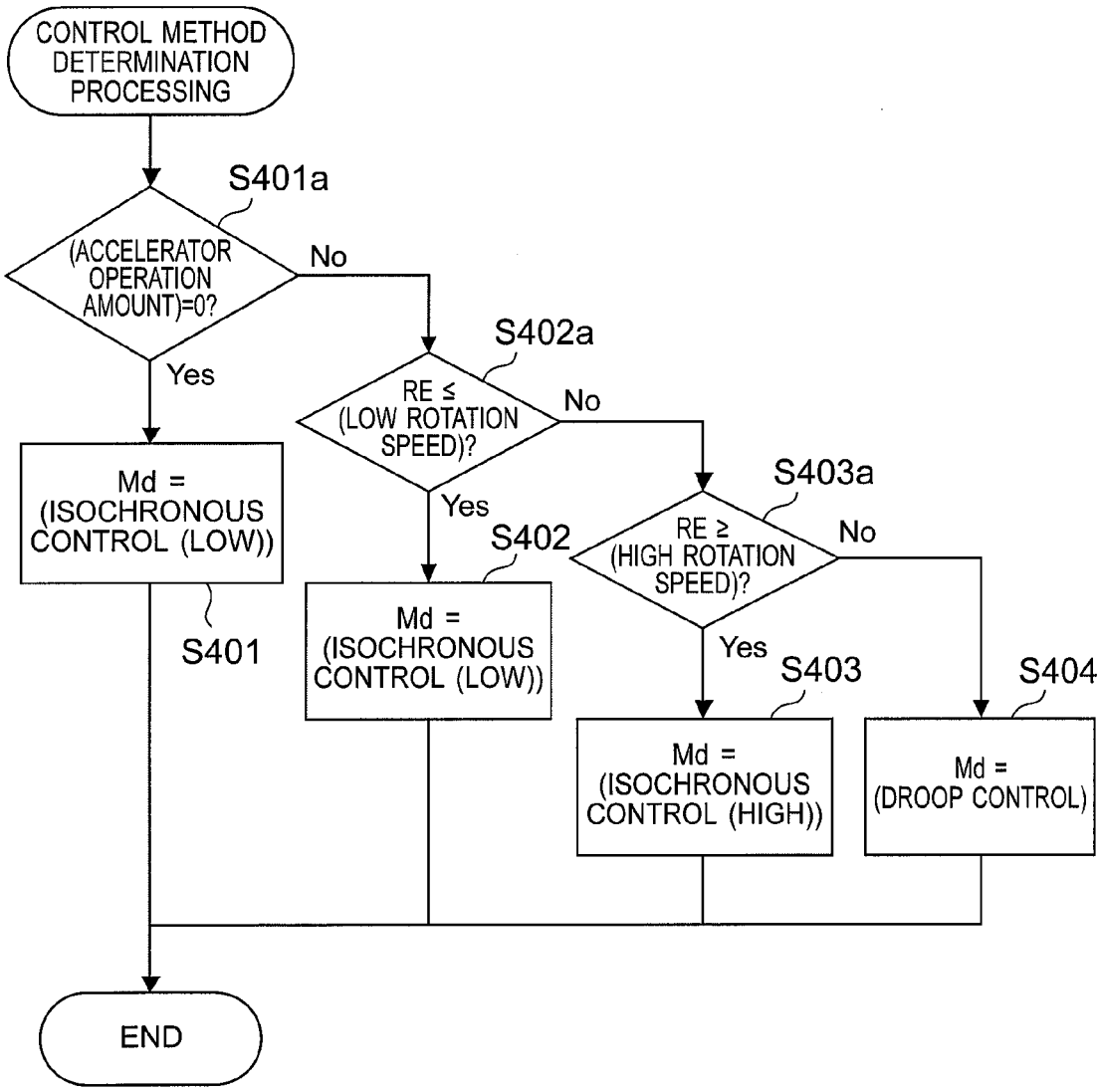
FIG. 6 is a flowchart illustrating an operation of the engine control apparatus according to the first embodiment of the present invention.
Figure 7:
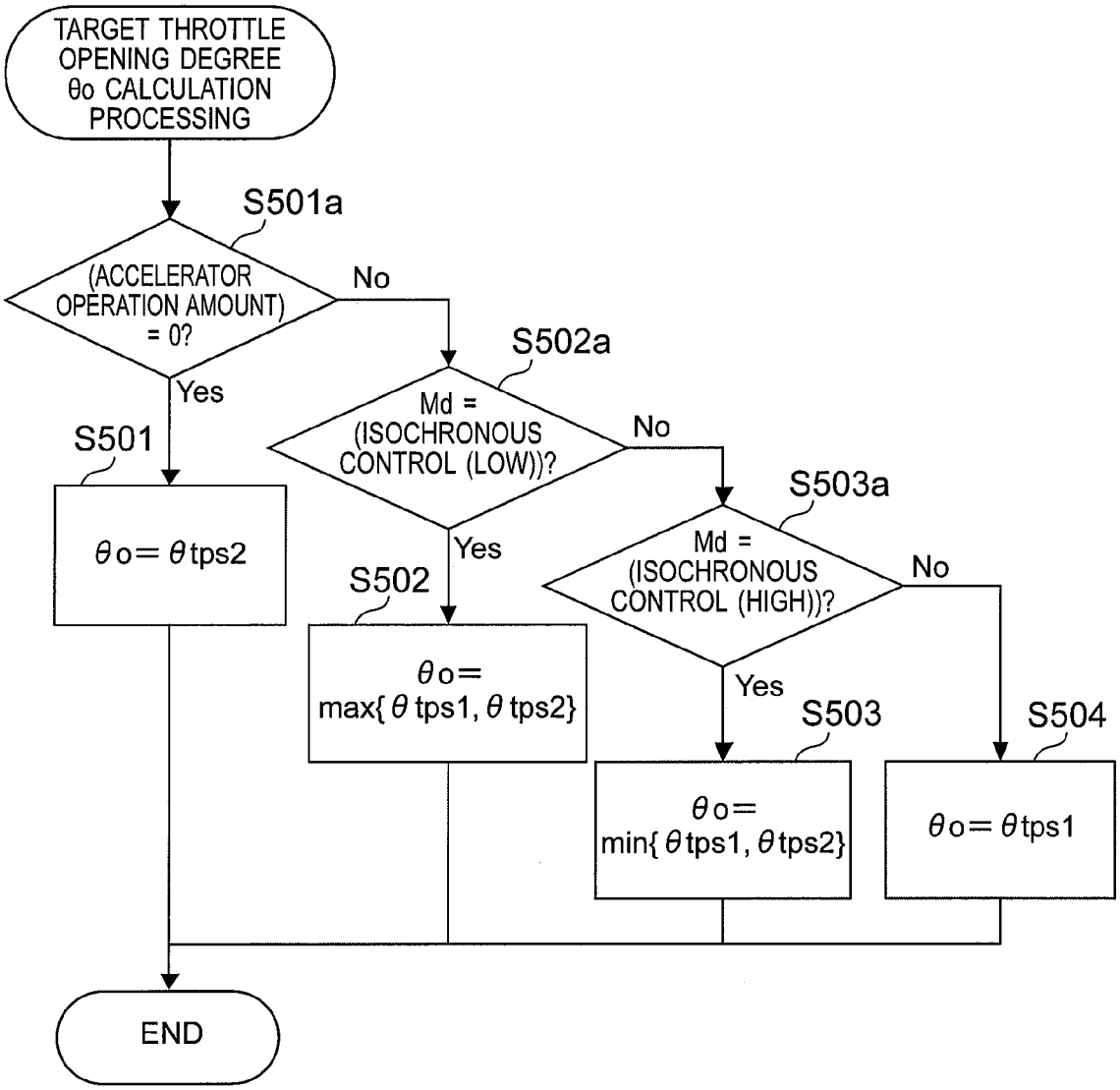
FIG. 7 is a flowchart illustrating an operation of the engine control apparatus according to the first embodiment of the present invention.
Figure 8:
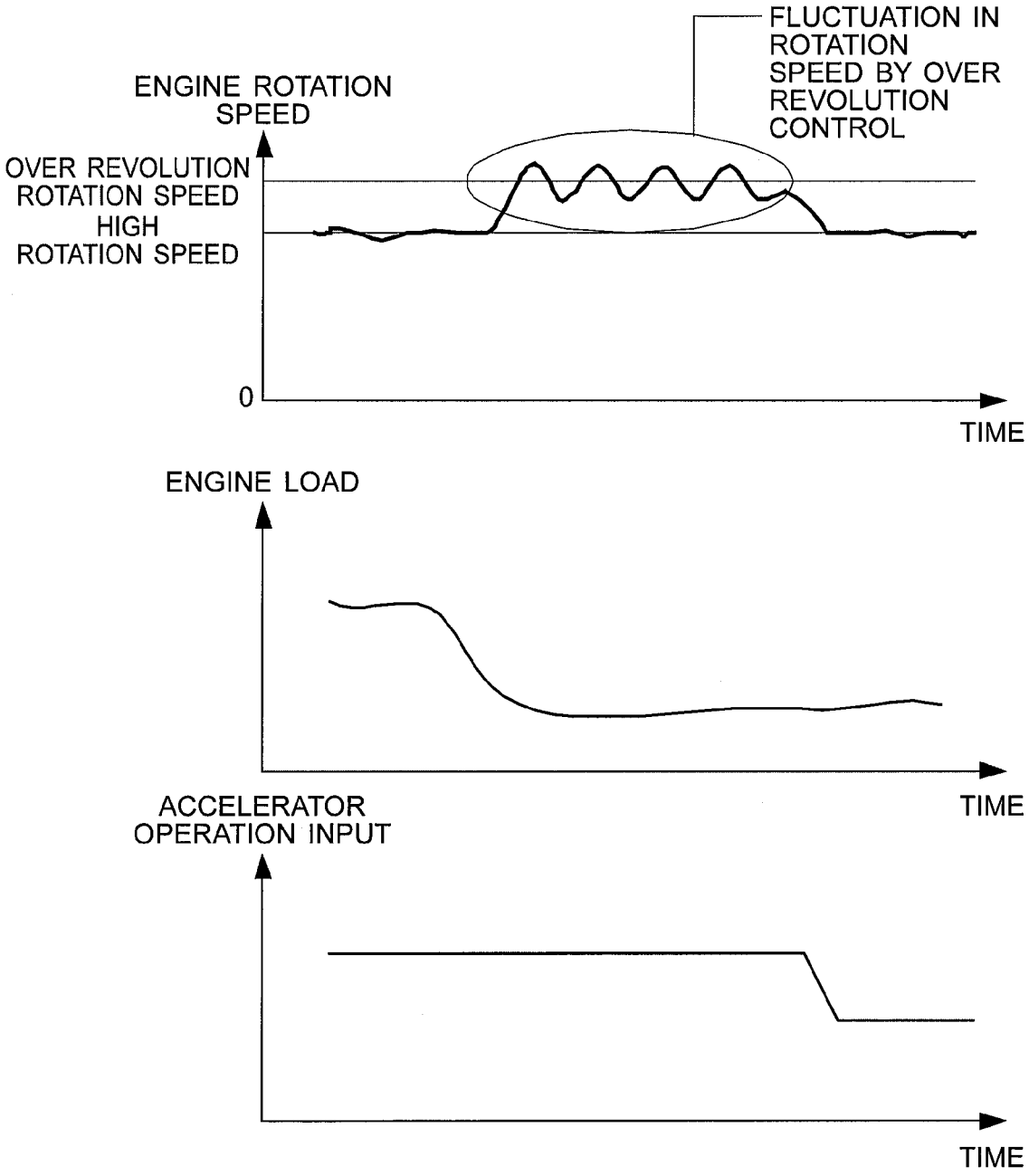
FIG. 8 is a graph showing a behavior of a related-art general-purpose engine using a mechanical governor.
Figure 9:
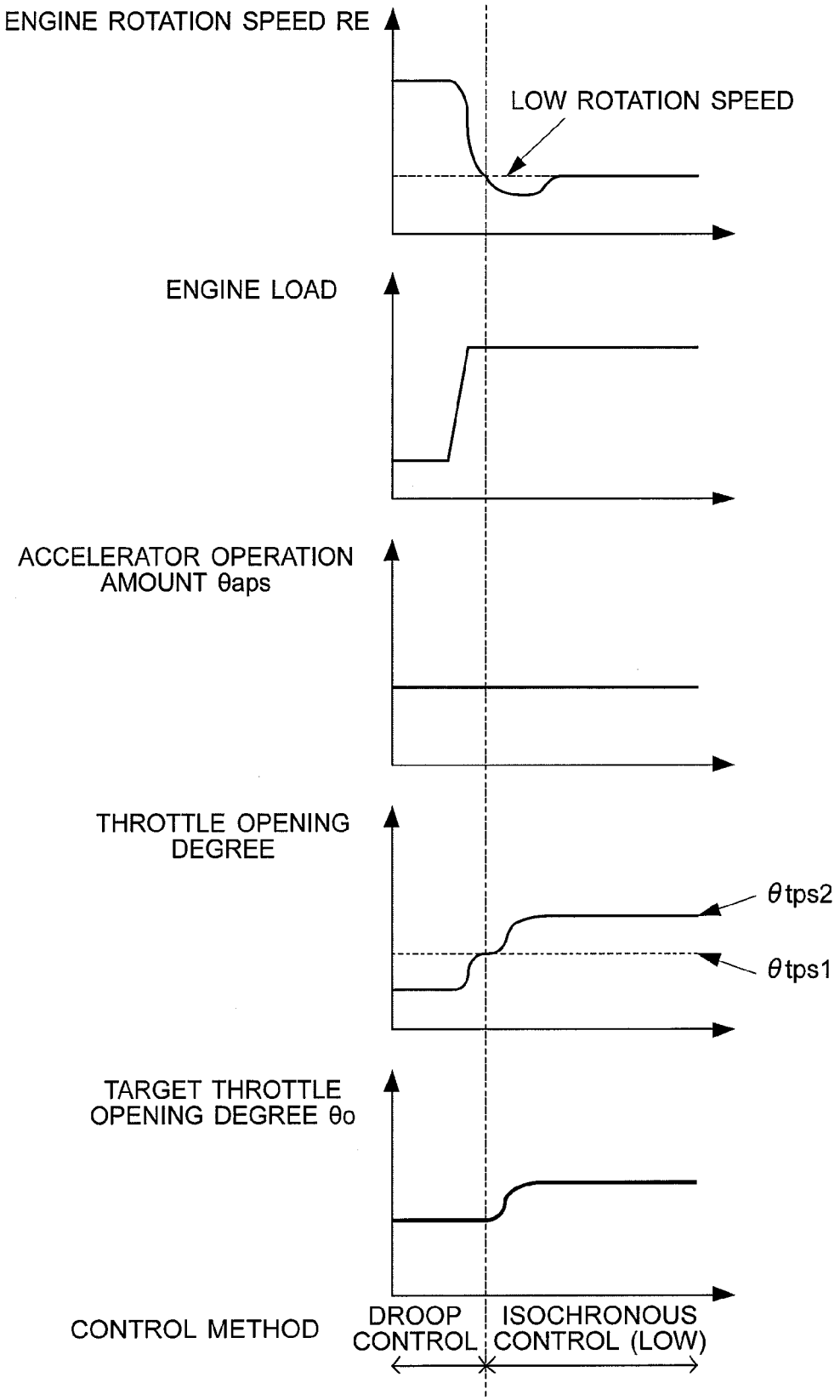
FIG. 9 is a graph showing a behavior of the engine by means of control by the engine control apparatus according to the first embodiment of the present invention.
Figure 10:
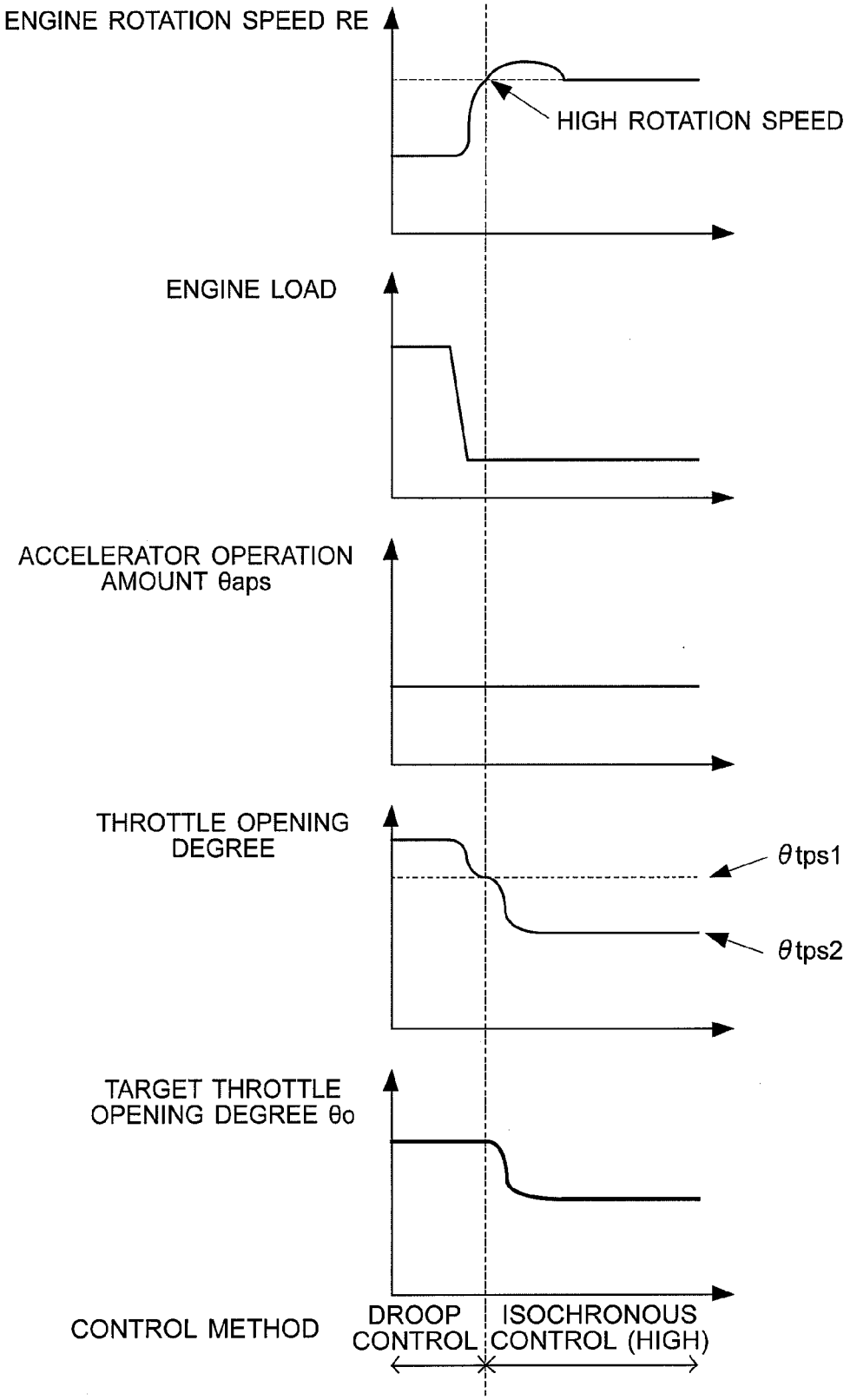
FIG. 10 is a graph showing a behavior of the engine by means of control by the engine control apparatus according to the first embodiment of the present invention.

Now, an operation according to the first embodiment of the present invention is described referring to flowcharts of FIGS. 3 to 7 and explanatory diagrams of FIGS. 8 to 10 together with FIGS. 1 and 2.

Figure 3:
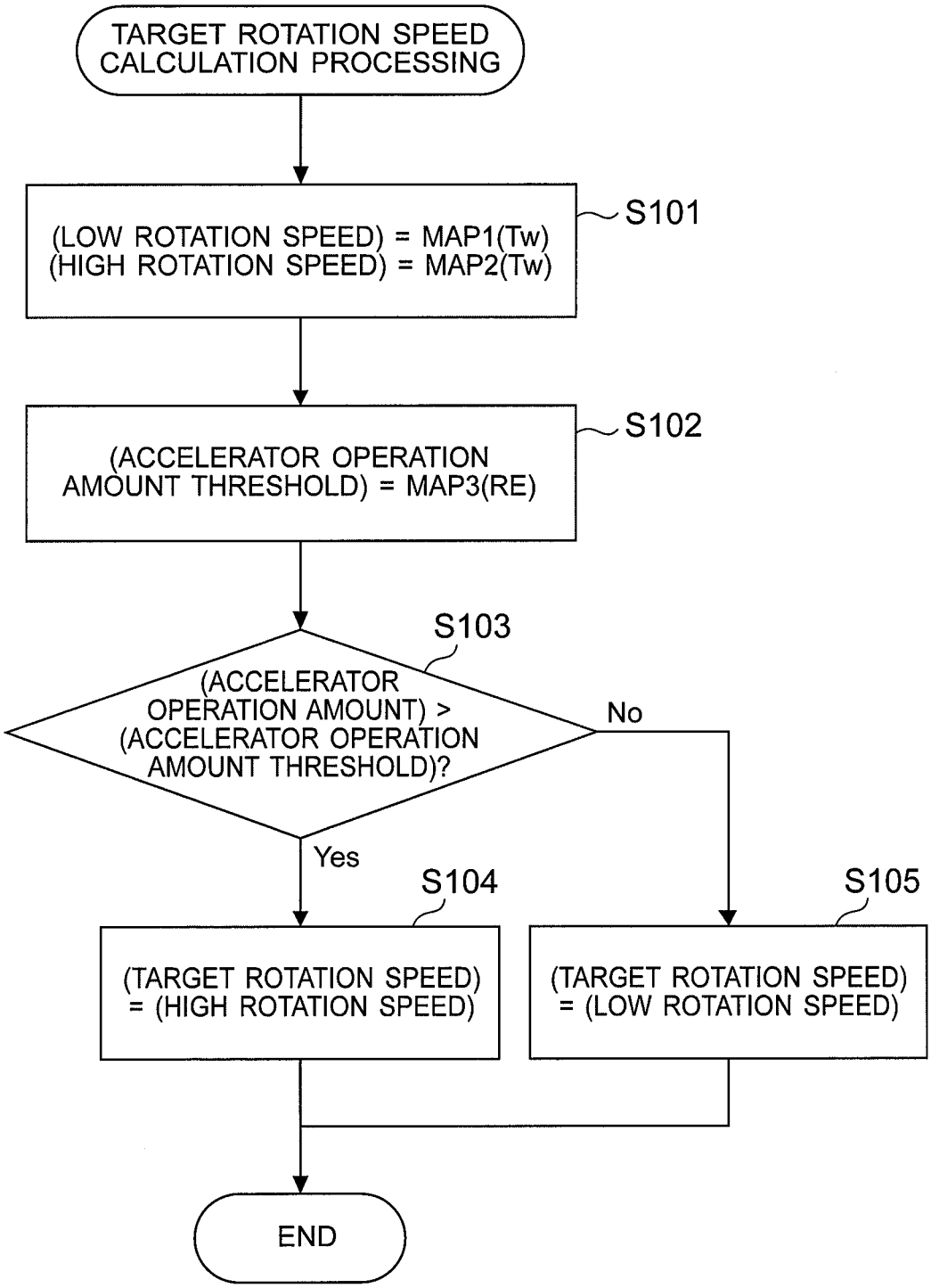
FIG. 3 is a flowchart illustrating an operation of the engine control apparatus according to the first embodiment of the present invention.
Figure 4:
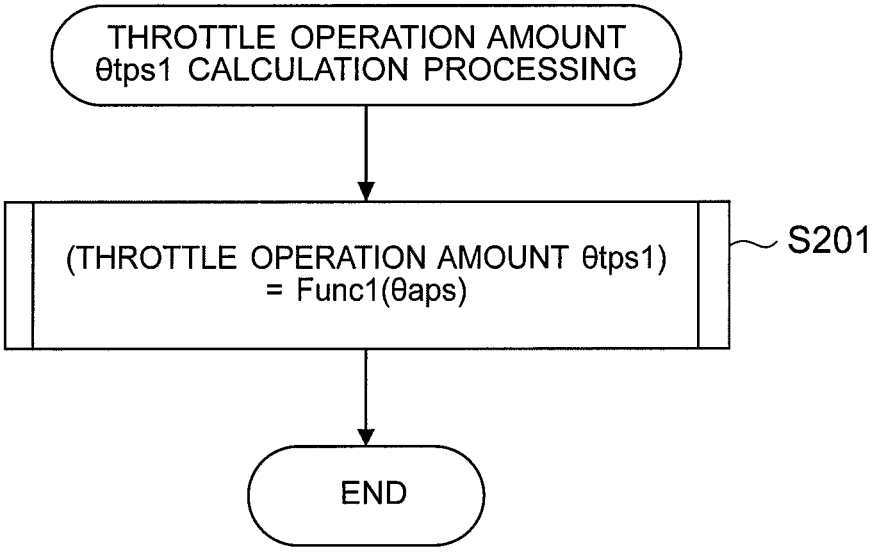
FIG. 4 is a flowchart illustrating an operation of the engine control apparatus according to the first embodiment of the present invention.
Figure 5:
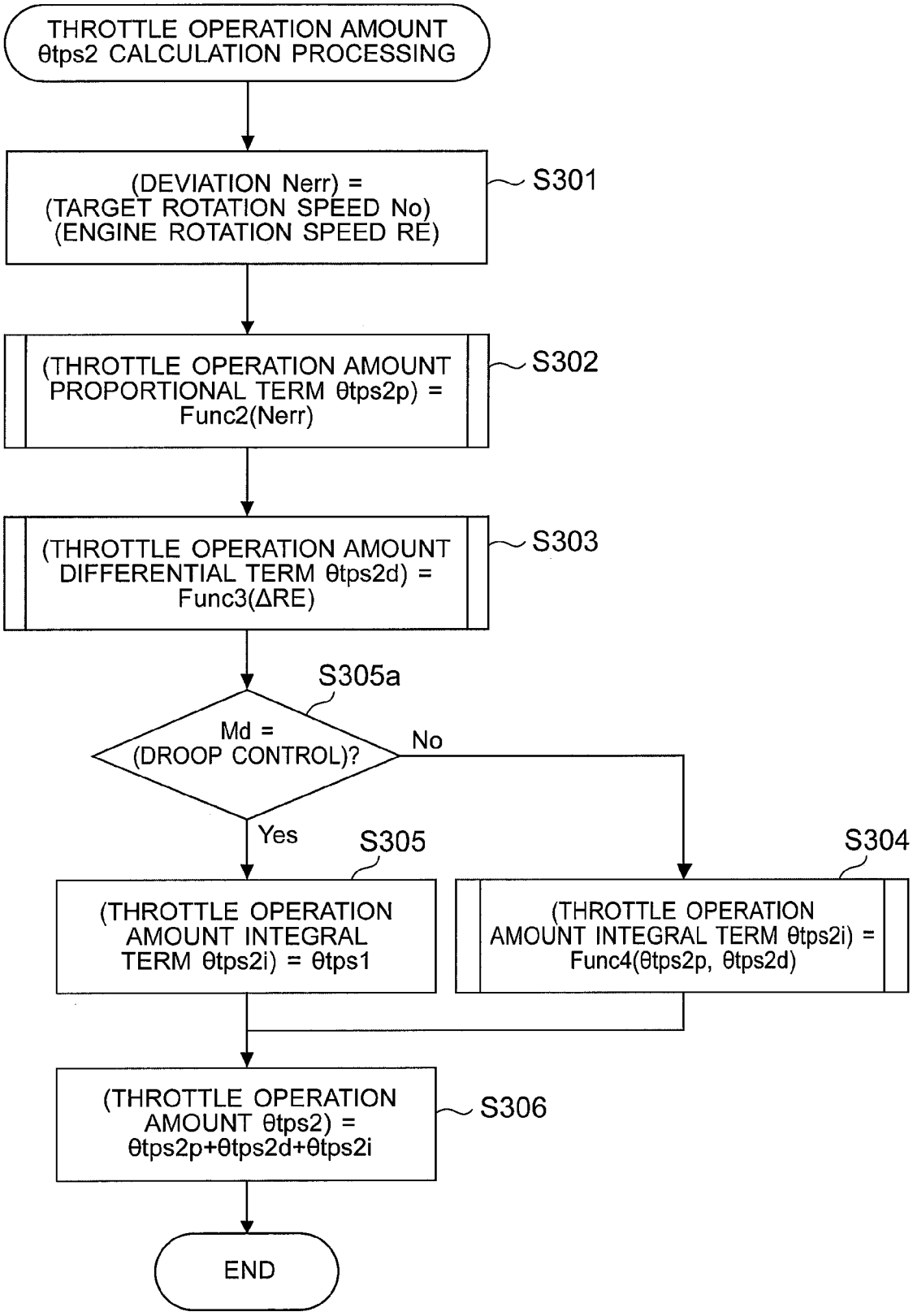
FIG. 5 is a flowchart illustrating an operation of the engine control apparatus according to the first embodiment of the present invention.

FIG. 3 is a flowchart illustrating target rotation speed calculation processing by the target rotation speed calculation section 23 according to the first embodiment of the present invention. FIG. 4 is a flowchart illustrating throttle operation amount θtps1 calculation processing by the droop control target throttle opening degree calculation section 24. FIG. 5 is a flowchart illustrating throttle operation amount θtps2 calculation processing by the isochronous control target throttle opening degree calculation section 25. FIG. 6 is a flowchart illustrating determination processing for the control method Md by the control method determination section 26. FIG. 7 is a flowchart illustrating target throttle opening degree θo calculation processing by the target throttle opening degree calculation section 27.

First, referring to FIG. 3, a description is given of the target rotation speed calculation processing by the target rotation speed calculation section 23. In FIG. 3, the target rotation speed calculation section 23 first calculates the LOW rotation speed and the HIGH rotation speed based on the engine coolant temperature Tw from the water temperature sensor 4 (Step S101). As a calculation method for the LOW rotation speed and the HIGH rotation speed, for example, maps MAP1 and MAP2 respectively storing a value of the LOW rotation speed and a value of the HIGH rotation speed for each engine coolant temperature Tw may be provided in advance, and a value of the LOW rotation speed and a value of the HIGH rotation speed corresponding to a current engine coolant temperature Tw may be read out from the maps MAP1 and MAP2 ((LOW rotation speed)=MAP1 (Tw) and (HIGH rotation speed)=MAP2 (Tw)). Then, the target rotation speed calculation section 23 calculates the accelerator operation amount threshold based on the engine rotation speed RE from the engine parameter calculation section 22 (Step S102), and compares the calculated accelerator operation amount threshold with the accelerator operation amount θaps from the accelerator position sensor 21*a* (Step S103). As the calculation method for the accelerator operation amount threshold, for example, a map MAP3 for storing an accelerator operation amount threshold for each engine rotation speed RE may be provided in advance, and an accelerator operation amount threshold corresponding to the current engine rotation speed RE may be read from the map MAP3 ((accelerator operation amount threshold)=MAP3 (RE)). As a result of the comparison in Step S103, when the accelerator operation amount θaps is larger than the accelerator operation amount threshold, the target rotation speed No is set to the HIGH rotation speed (Step S104). Otherwise, the target rotation speed No is set to the LOW rotation speed (Step S105). The target rotation speed calculation section 23 outputs the target rotation speed No acquired in this way.

Now, referring to FIG. 4, a description is given of the throttle operation amount θtps1 calculation processing by the droop control target throttle opening degree calculation section 24. In FIG. 4, the droop control target throttle opening degree calculation section 24 uses the accelerator operation amount θaps from the accelerator position sensor 21*a*, thereby acquiring the first throttle operation amount θtps1 for the droop control (Step S201). As a calculation method for the first throttle operation amount θtps1, for example, a function Fund of the accelerator operation amount θaps may be provided as a calculation equation for acquiring the first throttle operation amount θtps1, and the first throttle operation amount θtps1 may be acquired by using the equation ((first throttle operation amount θtps1)=Func1 (θaps)). The droop control target throttle opening degree calculation section 24 outputs the first throttle operation amount θtps1 acquired in this way.

Now, referring to FIG. 5, a description is given of the throttle operation amount θtps2 calculation processing by the isochronous control target throttle opening degree calculation section 25. In FIG. 5, the isochronous control target throttle opening degree calculation section 25 first uses the target rotation speed No input from the target rotation speed calculation section 23 and the engine rotation speed RE input from the engine parameter calculation section 22 to acquire the deviation Nerr between the target rotation speed No and the engine rotation speed RE (Step S301). Then, the isochronous control target throttle opening degree calculation section 25 calculates a throttle operation amount proportional term θtps2*p* based on the acquired deviation Nerr (Step S302). As a method of calculating the throttle operation amount proportional term θtps2*p*, for example, a function Func2 of the deviation Nerr may be provided in advance as the calculation equation for acquiring the throttle operation amount proportional term θtps2*p*, and may be used to acquire the throttle operation amount proportional term θtps2*p* ((throttle operation amount proportional term θtps2*p*)=Func2 (Nerr)). Then, the isochronous control target throttle opening degree calculation section 25 acquires a throttle operation amount derivative term θtps2*d* by using the engine rotation speed change amount ΔRE input from the engine parameter calculation section 22 (Step S303). As a method of calculating the throttle operation amount derivative term θtps2*d*, for example, a function Func3 of the engine rotation change amount ΔRE may be provided in advance as a calculation equation for acquiring the throttle operation amount derivative term θtps2*d*, and may be used to acquire the throttle operation amount derivative term θtps2*d* ((throttle operation amount derivative term θtps2*d*)=Func3 (ΔRE)). Then, the isochronous control target throttle opening degree calculation section 25 determines whether the control method Md input from the control method determination section 26 is the droop control method or not (Step S305*a*). On this occasion, when the control method Md is not the droop control method, the isochronous control target throttle opening degree calculation section 25 calculates a throttle operation amount integral term θtps2*i* based on the throttle operation amount proportional term θtps2*p* and the throttle operation amount derivative term θtps2*d* (Step S304). As a calculation method for the throttle operation amount integral term θtps2*i*, for example, a function Func4 of the throttle operation amount proportional term θtps2*p* and the throttle operation amount derivative term θtps2*d* may be provided in advance as a calculation equation for acquiring the throttle operation amount integral term θtps2*i*, and may be used to acquire the throttle operation amount integral term θtps2*i* ((throttle operation amount integral term θtps2*i*)=Func4 (θtps2*p*, θtps2*d*)). On the other hand, when the control method Md is the droop control method in the determination in Step S305*a*, the isochronous control target throttle opening degree calculation section 25 sets the throttle operation amount integral term θtps2*i* to the first throttle operation amount θtps1 acquired by the droop control target throttle opening degree calculation section 24 (Step S305). Then, the isochronous control target throttle opening degree calculation section 25 acquires a sum of the throttle operation amount proportional term θtps2*p*, the throttle operation amount derivative term θtps2*d*, and the throttle operation amount integral term θtps2*i*, and sets the sum as a second throttle operation amount θtps2 (Step S306). As described above, the isochronous control target throttle opening degree calculation section 25 always calculates the second throttle operation amount θtps2 by means of the PID control based on the deviation Nerr between the target rotation speed No and the engine rotation speed RE and the change amount ΔRE of the engine rotation speed when the control is carried out by means of the isochronous control method. The isochronous control target throttle opening degree calculation section 25 uses the first throttle operation amount θtps1 to fix the integral control value (throttle operation amount integration term) for the PID control to the initial value when the control is carried out by means of the droop control method. The isochronous control target throttle opening degree calculation section 25 outputs the second throttle operation amount θtps2 acquired in this way.

Referring to FIG. 6, a description is now given of the determination processing for the control method Md by the control method determination section 26. In FIG. 6, the control method determination section 26 first determines whether the accelerator operation amount θaps from the accelerator position sensor 21*a* is 0 or not (Step S401*a*). As a result of the determination, when the accelerator operation amount θaps is 0, the control method determination section 26 sets the control method Md to the isochronous control method (LOW) (Step S401). Note that, the isochronous control method (LOW) is an isochronous control method when the target rotation speed No is set to the LOW rotation speed acquired by the target rotation speed calculation section 23. On the other hand, when the accelerator operation amount θaps is not 0, the control method determination section 26 determines whether the rotation speed RE from the engine parameter calculation section 22 is equal to or lower than the LOW rotation speed or not (Step S402*a*). When the engine rotation speed RE is equal to or lower than the LOW rotation speed, the control method determination section 26 sets the control method Md to the isochronous control method (LOW) (Step S402). On the other hand, when the engine rotation speed RE is higher than the LOW rotation speed in the determination in Step S402*a*, the control method determination section 26 determines whether the engine rotation speed RE is equal to or higher than the HIGH rotation speed acquired by the target rotation speed calculation section 23 or not (Step S403*a*). When the engine rotation speed RE is equal to or higher than the HIGH rotation speed, the control method determination section 26 sets the control method Md to the isochronous control method (HIGH) (Step S403). Note that, the isochronous control method (HIGH) is an isochronous control method when the target rotation speed No is set to the HIGH rotation speed acquired in the target rotation speed calculation section 23. On the other hand, when the engine rotation speed RE is lower than the HIGH rotation speed in the determination in Step S403*a*, the control method determination section 26 sets the control method Md to the droop control method (Step S404). The control method determination section 26 outputs the control method Md acquired in this way.

Now, referring to FIG. 7, a description is given of the target throttle opening degree θo calculation processing by the target throttle opening degree calculation section 27. In FIG. 7, the target throttle opening degree calculation section 27 first determines whether the accelerator operation amount θaps from the accelerator position sensor 21*a* is 0 or not (Step S501*a*). As a result of the determination, when the accelerator operation amount θaps is 0, the target throttle opening degree calculation section 27 sets the target throttle opening degree θo to the second throttle operation amount θtps2 acquired by the isochronous control target throttle opening degree calculation section 25 (Step S501). On the other hand, when the accelerator operation amount θaps is not 0 in the determination in Step S501*a*, the target throttle opening degree calculation section 27 determines whether the control method Md determined by the control method determination section 26 is the isochronous control method (LOW) or not (Step S502*a*). When the control method Md is the isochronous control method (LOW), the target throttle opening degree calculation section 27 selects larger one of the first throttle operation amount θtps1 acquired by the droop control target throttle opening degree calculation section 24 and the second throttle operation amount θtps2 acquired by the isochronous control target throttle opening degree calculation section 25 as the target throttle opening degree θo (Step S502). On the other hand, when the control method Md is not the isochronous control method (LOW) in the determination in Step S502*a*, the target throttle opening degree calculation section 27 determines whether the control method Md is the isochronous control method (HIGH) or not (Step S503*a*). When the control method Md is the isochronous control method (HIGH), the target throttle opening degree calculation section 27 selects smaller one of the first throttle operation amount θtps1 and the second throttle operation amount θtps2 as the target throttle opening degree θo (Step S503). When the control method Md is other than the above-mentioned methods in the determination in Step S503*a*, the target throttle opening degree calculation section 27 sets the target throttle opening degree θo to the first throttle operation amount θtps1 (Step S504). In this way, the target throttle opening degree calculation section 27 selects the second throttle operation amount θtps2 as the target throttle opening degree θo when the accelerator operation amount is 0, selects larger one of the first throttle operation amount θtps1 and the second throttle operation amount θtps2 as the target throttle opening degree θo when the accelerator operation amount is not 0 and the target rotation speed No is set to the LOW rotation speed, selects smaller one of the first throttle operation amount θtps1 and the second throttle operation amount θtps2 as the target throttle opening degree θo when the accelerator operation amount is not 0 and the target rotation speed No is set to the HIGH rotation speed, and otherwise selects the first throttle operation amount θtps1 as the target throttle opening degree θo.

The engine control apparatus according to the first embodiment of the present invention automatically switches, as described above, the control method between the droop control method and the isochronous control method in response to the operation state, thereby realizing the rotation speed control across the entire rotation range. The isochronous control method, which determines the target throttle opening degree by means of the feedback control, is large in the steps and processes for adaptation compared with the droop control method in which the target throttle opening degree is uniquely determined. Related-art virtual droop control is extremely large in the steps and processes for adaptation by means of the isochronous control method across the entire rotation range, but the engine control apparatus according to the first embodiment of the present invention carries out the adaptation by means of the isochronous control method only in the necessary rotation range, and carries out the adaptation of the droop control in other rotation ranges, resulting in a reduction in steps and processes for adapting the droop control in the other rotation ranges.

Moreover, hitherto, as shown in FIG. 8, in an engine having a mechanical governor, in such a state that a load is applied to the engine and the engine is operating at the HIGH rotation speed (maximum set rotation speed), the engine rotation speed increases to a rotation speed equal to or higher than the HIGH rotation speed (maximum set rotation speed) when the load disappears, and the over revolution control, which is engine protection control, is activated, thereby generating a sudden change of the engine rotation speed. However, the engine control apparatus according to the first embodiment controls the throttle actuator (electronic throttle) 7*a* by means of the isochronous control method in such a state, and can thus provide the control without generating such a sudden change in the engine rotation that the over revolution control is activated.

FIGS. 9 and 10 respectively show a case where the engine load suddenly increases and a case where the engine load suddenly decreases during the droop control in the engine control apparatus according to the first embodiment of the present invention. As shown in FIG. 9, in a case where the target rotation speed No is set to the LOW rotation speed, the engine rotation speed RE decreases when the engine load suddenly increases. The rotation speed directly decreases below the LOW rotation speed in the droop control method, and hence an engine stall occurs in the worst case. However, in the first embodiment of the present invention, as shown in FIG. 9, the control migrates to the isochronous control method when the engine rotation speed RE decreases below the LOW rotation speed, thereby maintaining the LOW rotation speed, and hence the engine stall does not occur. Moreover, as shown in FIG. 10, in a case where the target rotation speed No is set to the HIGH rotation speed, the engine rotation speed RE increases when the engine load suddenly decreases. The engine rotation speed directly exceeds the HIGH rotation speed in the droop control method, and the over revolution control, which is the engine protection control, is activated. However, in the first embodiment of the present invention, the control migrates to the isochronous control method when the engine rotation speed RE exceeds the HIGH rotation speed, thereby maintaining the HIGH rotation speed, and hence the over revolution control does not occur.

In FIGS. 9 and 10, in a case where the droop control method is switched to the isochronous control method when the engine rotation speed decreases below the LOW rotation speed or increases above the HIGH rotation speed, the switching control cannot be carried out in time due to a sudden rotation change in some cases. Therefore, in Steps S104 and S105 of FIG. 3, the LOW rotation speed/HIGH rotation speed may be corrected by using values derived from the engine rotation speed RE and the change amount ΔRE thereof, thereby earlier switching to the isochronous control method, and the correction amounts may be gradually decreased after the switching of the control, thereby eliminating the sense of discomfort when the control is switched.

As described above, the engine control apparatus according to the first embodiment of the present invention controls the intake air amount supplied to the engine 1 by using the throttle actuator 7*a* (electronic throttle), thereby controlling the engine rotation speed RE of the engine 1 by means of the droop control method or the isochronous control method. The engine control apparatus includes: the engine parameter calculation section 22 for detecting the engine rotation speed RE; the accelerator position sensor 21*a* (accelerator operation amount detection section) for detecting the accelerator operation amount θaps of the accelerator pedal 21 by the driver; the target rotation speed calculation section 23 for acquiring the LOW rotation speed, which is the minimum set rotation speed of the engine 1 with respect to the engine coolant temperature Tw of the engine 1, and the HIGH rotation speed, which is the maximum set rotation speed thereof, and selecting, based on the engine rotation speed RE and the accelerator operation amount θaps, any one of the LOW rotation speed and the HIGH rotation speed as the target rotation speed No of the engine 1; the droop control target throttle opening degree calculation section 24 for calculating the first throttle operation amount θtps1 for controlling the throttle actuator 7*a* by means of the droop control method based on the accelerator operation amount θaps; the isochronous control target throttle opening degree calculation section 25 for acquiring the deviation Nerr between the engine rotation speed RE and the target rotation speed No, thereby calculating the second throttle operation amount θtps2 for operating the throttle actuator 7*a* by means of the isochronous control method based on the deviation Nerr; the control method determination section 26 for selecting, based on the accelerator operation amount θaps and the engine rotation speed RE, any one of the droop control method and the isochronous control method as the control method Md; the target throttle opening degree calculation section 27 for selecting, based on the accelerator operation amount θaps and the control method Md, any one of the first throttle operation amount θtps1 and the second throttle operation amount θtps2 as the target throttle opening degree θo; and the electronic throttle control section 28 for controlling the throttle actuator 7*a* based on the target throttle opening degree θo. When the accelerator operation amount θaps is 0, the target throttle opening degree calculation section 27 selects the second throttle operation amount θtps2, and the electronic throttle control section 28 uses the second throttle operation amount θtps2, thereby controlling the throttle actuator 7*a* by means of the isochronous control method. On the other hand, when the accelerator operation amount θaps is not 0, in a case where the engine rotation speed RE is equal to or lower than the LOW rotation speed or equal to or higher than the HIGH rotation speed and the control method determination section 26 selects the isochronous control method as the control method Md, the target throttle opening degree calculation section 27 selects any one of the first throttle operation amount θtps1 and the second throttle operation amount θtps2, and the electronic throttle control section 28 carries out, based on the selection, the control of the throttle actuator 7*a* by means of the isochronous control method. Otherwise, the target throttle opening degree calculation section 27 selects the first throttle operation amount θtps1, and the electronic throttle control section 28 uses the first throttle operation amount θtps1 to control the throttle actuator 7*a* by means of the droop control method. As shown in FIG. 9, this configuration prevents the engine 1 from stalling by switching the control method from the droop control method to the isochronous control method (LOW) when the engine rotation speed RE decreases to a rotation speed equal to or lower than the LOW rotation speed. Moreover, when the engine rotations speed RE increases to a rotation speed equal to or higher than the HIGH rotation speed, as shown in FIG. 10, the control method is switched from the droop control method to the isochronous control method (HIGH), thereby preventing the rotation of the engine 1 from increasing, and such the control that the engine rotation speed RE does not exceed the HIGH rotation speed is provided. Moreover, the gain setting in the isochronous control method is only necessary for the LOW rotation speed and the HIGH rotation speed, and is not necessary across the entire engine operation range, resulting in possible reduction in steps and processes for adaptation. Moreover, also in a case where the droop control is realized when the load changes suddenly, the droop control can be realized by a small amount of the steps and processes, the engine stall can be prevented when the sudden load is applied to the engine, and the rotation fluctuation as a result of the over revolution control can be prevented when the load on the engine suddenly decreases.

Moreover, in the first embodiment, when the isochronous control method is selected as the control method Md as illustrated in FIG. 5, the isochronous control target throttle opening degree calculation section 25 always calculates the second throttle operation amount θtps2 based on the deviation Nerr between the target rotation speed No and the engine rotation speed RE and the change amount ΔRE of the engine rotation speed by means of feedback control (PID control). On the other hand, when the droop control method is selected as the control method Md, the isochronous control target throttle opening degree calculation section 25 fixes the integral control value (throttle operation amount integral term) in the feedback control (PID control) to the first throttle operation amount θtps1. As a result, when a range where the operation is carried out by means of the droop control method is switched to an isochronous control range, responsiveness of the PID control can be increased, thereby quickly converging the engine rotation speed RE to the LOW rotation speed or the HIGH rotation speed.

Moreover, in the first embodiment, as illustrated in FIG. 3, the target rotation speed calculation section 23 acquires the accelerator operation amount threshold based on the engine rotation speed RE. Then, when the accelerator operation amount θaps is larger than the accelerator operation amount threshold, the target rotation speed calculation section 23 sets the HIGH rotation speed as the target rotation speed No, and, on the other hand, when the accelerator operation amount θaps is equal to or less than the accelerator operation amount threshold, sets the LOW rotation speed as the target rotation speed No. Moreover, the isochronous control method includes the isochronous control method (LOW) (first isochronous control method) having the target rotation speed No set to the LOW rotation speed. As illustrated in FIG. 6, when the accelerator operation amount θaps is not 0 and the engine rotation speed RE is equal to or lower than the LOW rotation speed, the control method determination section 26 selects the isochronous control method (LOW) as the control method Md, and the target throttle opening degree calculation section 27 selects larger one of the first throttle operation amount θtps1 and the second throttle operation amount θtps2 as the target throttle opening degree θo. As a result, when the state where the accelerator operation amount is 0 and the rotation speed is controlled so as to reach the LOW rotation speed by the isochronous control method is switched to a state where the accelerator operation amount is not 0 and the control enters the droop control range, hunting and a drop in rotation speed when the control is switched can be prevented by selecting larger one of the first throttle operation amount θtps1 and the second throttle operation amount θtps2.

Further, in the first embodiment, the isochronous control method includes the isochronous control method (HIGH) (second isochronous control method) having the target rotation speed No set to the HIGH rotation speed. When the accelerator operation amount θaps is not 0 and the engine rotation speed RE is equal to or higher than the HIGH rotation speed, the control method determination section 26 selects the isochronous control method (HIGH) as the control method Md, and the target throttle opening degree calculation section 27 selects smaller one of the first throttle operation amount θtps1 and the second throttle operation amount θtps2 as the target throttle opening degree θo. As a result, when a state where the isochronous control is provided based on the accelerator operation amount θaps so that the rotation speed reaches the HIGH rotation speed is switched to the droop control method, hunting and a rise in rotation speed when the control is switched can be prevented by selecting smaller one of the first throttle operation amount θtps1 and the second throttle operation amount θtps2.

A description of the first embodiment has been given while the general-purpose engine is exemplified as the engine, but it should be understood that the engine is not limited to the general-purpose engine and the present invention can be generally applied to engines.

The invention claimed is:

1. An engine control apparatus for controlling an engine rotation speed of an engine by means of any one of a droop control method and an isochronous control method by controlling an intake air amount supplied to the engine by means of an electronic throttle, the engine control apparatus comprising:

an engine parameter calculation section for detecting the engine rotation speed;

an accelerator operation amount detection section for detecting an accelerator operation amount;

a target rotation speed calculation section for acquiring a LOW rotation speed, which is a minimum set rotation speed of the engine with respect to an engine coolant temperature of the engine, and a HIGH rotation speed, which is a maximum set rotation speed thereof, and selecting, based on the engine rotation speed and the accelerator operation amount, any one of the LOW rotation speed and the HIGH rotation speed as a target rotation speed of the engine;

a droop control target throttle opening degree calculation section for calculating, based on the accelerator operation amount, a first throttle operation amount for operating the electronic throttle by means of the droop control method;

an isochronous control target throttle opening degree calculation section for acquiring a deviation between the engine rotation speed and the target rotation speed, and calculating, based on the deviation, a second throttle operation amount for operating the electronic throttle by means of the isochronous control method;

a control method determination section for selecting, based on the accelerator operation amount and the engine rotation speed, any one of the droop control method and the isochronous control method as a control method;

a target throttle opening degree calculation section for selecting, based on the accelerator operation amount and the control method, any one of the first throttle operation amount and the second throttle operation amount as a target throttle opening degree; and an electronic throttle control section for controlling the electronic throttle based on the target throttle opening degree, wherein:

when the accelerator operation amount is 0, the target throttle opening degree calculation section selects the second throttle operation amount, and the electronic throttle control section controls the electronic throttle by means of the isochronous control method by using the second throttle operation amount; and when the accelerator operation amount is not 0, in a case where the engine rotation speed is one of equal to or lower than the LOW rotation speed and equal to or higher than the HIGH rotation speed and the isochronous control method is selected by the control method determination section as the control method, the target throttle opening degree calculation section selects based on the control method any one of the first throttle operation amount and the second throttle operation amount, and the electronic throttle control section controls, based on the selection, the electronic throttle by means of the isochronous control method, and otherwise, the target throttle opening degree calculation section selects the first throttle operation amount, and the electronic throttle control section controls the electronic throttle by means of the droop control method by using the first throttle operation amount.

2. An engine control apparatus according to claim 1, wherein the isochronous control target throttle opening degree calculation section always calculates the second throttle operation amount based on the deviation between the target rotation speed and the engine rotation speed and a change amount of the engine rotation speed by means of feedback control when the isochronous control method is selected as the control method; and fixes an integral control value in the feedback control to the first throttle operation amount when the droop control method is selected as the control method.

3. An engine control apparatus according to claim 1, wherein the target rotation speed calculation section acquires an accelerator operation amount threshold based on the engine rotation speed, and when the accelerator operation amount is larger than the accelerator operation amount threshold, sets the HIGH rotation speed as the target rotation speed, and when the accelerator operation amount is equal to or less than the accelerator operation amount threshold, sets the LOW rotation speed as the target rotation speed.

4. An engine control apparatus according to claim 3, wherein:

the isochronous control method includes a first isochronous control method having the target rotation speed set to the LOW rotation speed; and when the accelerator operation amount is not 0 and the engine rotation speed is equal to or lower than the LOW rotation speed, the control method determination section selects the first isochronous control method as the control method, and the target throttle opening degree calculation section selects larger one of the first throttle operation amount and the second throttle operation amount as the target throttle opening degree.

5. An engine control apparatus according to claim 3, wherein:

the isochronous control method includes a second isochronous control method having the target rotation speed set to the HIGH rotation speed; and when the accelerator operation amount is not 0 and the engine rotation speed is equal to or higher than the HIGH rotation speed, the control method determination section selects the second isochronous control method as the control method, and the target throttle opening degree calculation section selects smaller one of the first throttle operation amount and the second throttle operation amount as the target throttle opening degree.

6. An engine control method for controlling an engine rotation speed of an engine by means of any one of a droop control method and an isochronous control method by controlling an intake air amount supplied to the engine by means of an electronic throttle, the engine control method comprising:

an engine parameter calculation step for detecting the engine rotation speed;

an accelerator operation amount detection step for detecting an accelerator operation amount;

a target rotation speed calculation step for acquiring a LOW rotation speed, which is a minimum set rotation speed of the engine with respect to an engine coolant temperature of the engine, and a HIGH rotation speed, which is a maximum set rotation speed thereof, and selecting, based on the engine rotation speed and the accelerator operation amount, any one of the LOW rotation speed and the HIGH rotation speed as a target rotation speed of the engine;

a droop control target throttle opening degree calculation step for calculating a first throttle operation amount for operating the electronic throttle by means of the droop control method based on the accelerator operation amount;

an isochronous control target throttle opening degree calculation step for acquiring a deviation between the engine rotation speed and the target rotation speed, and calculating a second throttle operation amount for operating the electronic throttle by means of the isochronous control method based on the deviation;

a control method determination step for selecting, based on the accelerator operation amount and the engine rotation speed, any one of the droop control method and the isochronous control method as a control method;

a target throttle opening degree calculation step for selecting, based on the accelerator operation amount and the control method, any one of the first throttle operation amount and the second throttle operation amount as a target throttle opening degree; and an electronic throttle control step for controlling the electronic throttle based on the target throttle opening degree, wherein:

when the accelerator operation amount is 0, the target throttle opening degree calculation step comprises selecting the second throttle operation amount, and the electronic throttle control step comprises using the second throttle operation amount, thereby controlling the electronic throttle by means of the isochronous control method; and when the accelerator operation amount is not 0, in a case where the engine rotation speed is one of equal to or lower than the LOW rotation speed and equal to or higher than the HIGH rotation speed and the isochronous control method is selected as the control method in the control method determination step, the target throttle opening degree calculation step comprises selecting any one of the first throttle operation amount and the second throttle operation amount, and the electronic throttle control step comprises carrying out, based on the selection, the control of the electronic throttle by means of the isochronous control method, and otherwise, the target throttle opening degree calculation step comprises selecting the first throttle operation amount, and the electronic throttle control step comprises using the first throttle operation amount, thereby controlling the electronic throttle by means of the droop control method.

* * * * *